US006865935B2

(12) United States Patent
Vandervort

(10) Patent No.: US 6,865,935 B2
(45) Date of Patent: Mar. 15, 2005

(54) SYSTEM AND METHOD FOR STEAM TURBINE BACKPRESSURE CONTROL USING DYNAMIC PRESSURE SENSORS

(75) Inventor: Christian L. Vandervort, Voorheesville, NY (US)

(73) Assignee: General Electric Company, Schenectady, NY (US)

( * ) Notice: Subject to any disclaimer, the term of this patent is extended or adjusted under 35 U.S.C. 154(b) by 51 days.

(21) Appl. No.: 10/331,618

(22) Filed: Dec. 30, 2002

(65) Prior Publication Data

US 2004/0128035 A1 Jul. 1, 2004

(51) Int. Cl.[7] ..... G01M 19/00

(52) U.S. Cl. ..... 73/168; 73/861.335; 73/861.79; 73/861.84

(58) Field of Search ..... 73/861.79–861.85, 73/861.335, 168, 1.27, 1.28

(56) References Cited

U.S. PATENT DOCUMENTS 3,935,558 A * 1/1976 Miller et al. ..... 340/626
4,218,878 A * 8/1980 Kiscaden et al. ..... 60/39.091
5,571,966 A * 11/1996 Tsuboi ..... 73/579
5,735,125 A 4/1998 Tarelin et al.

FOREIGN PATENT DOCUMENTS

JP 55153805 A * 12/1980 ..... F01D/21/14
JP 04259606 A * 9/1992 ..... F01D/21/00

* cited by examiner

*Primary Examiner*—Edward Lefkowitz
*Assistant Examiner*—Jermaine Jenkins
(74) *Attorney, Agent, or Firm*—Polster, Lieder, Woodruff & Lucchesi, L.C.

(57) ABSTRACT

A system (10) controlling operation of a steam turbine (T). Sensors (12) measure dynamic pressure level variations in a stage (S1–Sn) of the turbine. A signal (Ps) from a sensor is converted to a frequency based signal (Fs). A comparator (16) compares the pressure levels at various frequencies as represented by the frequency based signal (Fs) to a matrix of limiting values including both alarm and trip signal limits. The control system provides an alarm to an operator of the steam turbine if the comparison indicates that an alarm limit has been exceeded, or takes the steam turbine off line, if a trip signal limit has been exceeded. This is done to prevent damage to the steam turbine. However, the control system maintains the steam turbine in operation if no aeromechanical disturbances or instabilities, as sensed by the sensors, has occurred.

23 Claims, 5 Drawing Sheets

SYSTEM AND METHOD FOR STEAM TURBINE BACKPRESSURE CONTROL USING DYNAMIC PRESSURE SENSORS

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to a control system and a method for increasing the operational flexibility of a steam turbine for variations in ambient temperature and/or condenser cooling capability. These variations impact the steam turbine by changing the exhaust or backpressure of the system.

Steam turbines accept high pressure, high temperature steam which expands through stationary and moving rows of nozzles and blades ("buckets") to convert heat energy into mechanical (rotational) energy. Combining a steam turbine with an electrical generator allows electric energy to be produced. FIG. 1 illustrates a representative steam turbine power plant. As shown in FIG. 1, a steam turbine T drives an electrical generator G through the turning of a rotor R on which blades or buckets B are mounted. The turbine is typically comprised of a series of stages S1–Sn with stage Sn being the last stage of the turbine. Steam flow to the turbine is through a control valve V and steam is directed at the buckets through nozzles or diaphragms N. A coolant (air or circulating water) is provided through a condenser C. Those skilled in the art know it is common practice to include both a gas turbine with a steam turbine to create a combined unit. Such a configuration has very high efficiency because steam for the steam turbine is generated from the thermal energy in the gas turbine exhaust.

Steam turbines are either condensing or non-condensing. For condensing steam turbines, a recommended exhaust pressure is established by the design of the last stages of the turbine, and the ability of a condenser C to accept exhaust heat energy. The cooling capability of the condenser can be a limiting factor if it results in the system being unable to achieve maximum steam expansion in turbine T. Such a limitation is particularly acute on hot days (for air condensers), or for periods when there is insufficient cooling water (for water-cooled condensers). Usually these are the same times when electric power demand is greatest, and the selling price of electricity the highest, so the limitations are most pronounced during these times. Further, limited cooling capacity results in higher backpressures which may force generating plants to reduce their electricity output until backpressure levels return to within acceptable limits.

Plant operators are often challenged to operate at higher than recommended backpressures during peak demand times because of the power generation demands. However, sustained operation at higher than recommended backpressures will result in blade response that significantly increases the probability of a high cycle fatigue failure due to aeromechanical instabilities. Even short-term operation at higher than normal backpressures can result in irreversible, cumulative blade fatigue that may necessitate taking the turbine out of service for repair. A typical backpressure range for a steam turbine power plant is approximately 1.0 to 3.0 inches Hg when using a water-cooled condenser C. For installations with air condensers, this range increases to 3.0 to 5.5 inches Hg. For a nearly constant steam flow, the backpressure can increase to twice these levels on days when limited cooling or high ambient temperatures are experienced.

Since operations at higher backpressures results in a steam turbine performing outside its design capabilities, a feedback system is provided within turbine T to prevent its operation in unsafe conditions. The feedback comprises a combination of alarm indications and trip set points which result in taking turbine T "off line". Specifically, as exhaust or backpressure increases, the incidence angle of steam flow significantly deviates from an optimum angle. This produces flow separation within the turbine which results in high bucket excitation, vibratory response, and potential bucket failure. Currently, trip set points are based upon static backpressure measured in accordance with established general rules of operation. The protective features prevent aeromechanic instabilities such as blade stall, flutter, and buffeting.

Control systems for steam turbines currently use fixed set points on backpressure to protect from aeromechanic instabilities. The recommended set points are based upon turbine class, blade design, and blade size. A drawback of such control systems is that set points for alarm and tripping are based solely upon static pressure levels; and as such, tend to be conservative. Turbine exhaust pressure limitations minimize the possibility of failures at high blade or bucket cycles which are induced by flow disturbance or aeromechanical instabilities. FIG. 2 provides a schematic of a representative control system S. Here, set points are commonly a function of exhaust flow velocity and typical values vary from 4 to 10 inches of Hg, vacuum. An alarm is initiated as these limits are approached to warn an operator to take appropriate action to lower the backpressure. The operator can, for example, reduce the load or increase condenser cooling. If unabated, however, further increases in backpressure (by between 1 to 3 inches Hg) results in the protective system tripping the steam turbine and taking it off line. FIG. 3 illustrates a commonly applied control schedule.

There is currently a need for steam turbines that can operate over a wide range of backpressures, particularly, at high backpressures. The problem is to increase allowable operating range for a condensing-type steam turbine through an improved means of providing backpressure protection. It is also important to provide aeromechanical protection to the steam turbine blades without unduly restricting the turbine's operational capabilities.

BRIEF SUMMARY OF THE INVENTION

The present invention is directed to condensing steam turbines where the exhaust pressure is maintained below atmospheric pressure, or at a vacuum. As noted, typical operating backpressures range from about 1 to 5 inches Hg vacuum. A control system of the invention controls operation of a steam turbine. Sensors measure dynamic pressure level variations in the last stage of the turbine. A sensor signal is converted to a frequency based signal and a comparator compares the pressure levels at various frequencies, as represented by the frequency based signal, to a matrix of limiting values including both alarm and trip signal limits. The control system provides an alarm to an operator of the steam turbine if the comparison indicates that an alarm limit has been exceeded, or takes the steam turbine off line, if a trip signal limit has been exceeded. This is done to prevent damage to the steam turbine. However, the control system maintains the steam turbine in operation if no aeromechanical disturbances or instabilities, as sensed by the sensors, have occurred.

Such an approach allows the turbine to operate over a wider range of backpressures, with protective actions being initiated only when un-acceptable stress amplitudes occur, as measured by the resulting local dynamic pressure pulsations, and provides operational flexibility for steam turbines over a wide range of backpressures.

By providing greater operational flexibility, a plant operator can now generate power at full plant capacity under higher condenser pressures. Since this usually occurs at times of peak power demand and higher electricity prices, the user not only can supply adequate power to meet the demand, but also realize higher earnings from the power generation.

The present invention further provides benefits for transient events as well as for sustained operation. For example, during a transient load rejection (breaker open event) in a combined gas and steam turbine plant, there is a several minute period when steam flow continues to the turbine, but the generator is unable to convert the energy into electricity. The steam turbine continues to operate, but at a slightly increased speed above what is normally allowed by turbine's control system. At this time, condenser backpressure rises to a level where current control schedules would likely trip the unit (depending upon the size of a condenser C and the amount of excess cooling capability). Use of dynamic pressure sensors, in accordance with the present invention, now enables sustained operation without a trip, assuming no actual aeromechanical disturbances or instabilities have occurred. When the problem that triggered the load rejection has been resolved, the system can be synchronized, the generator breaker re-closed, and the plant restored to service.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 4:
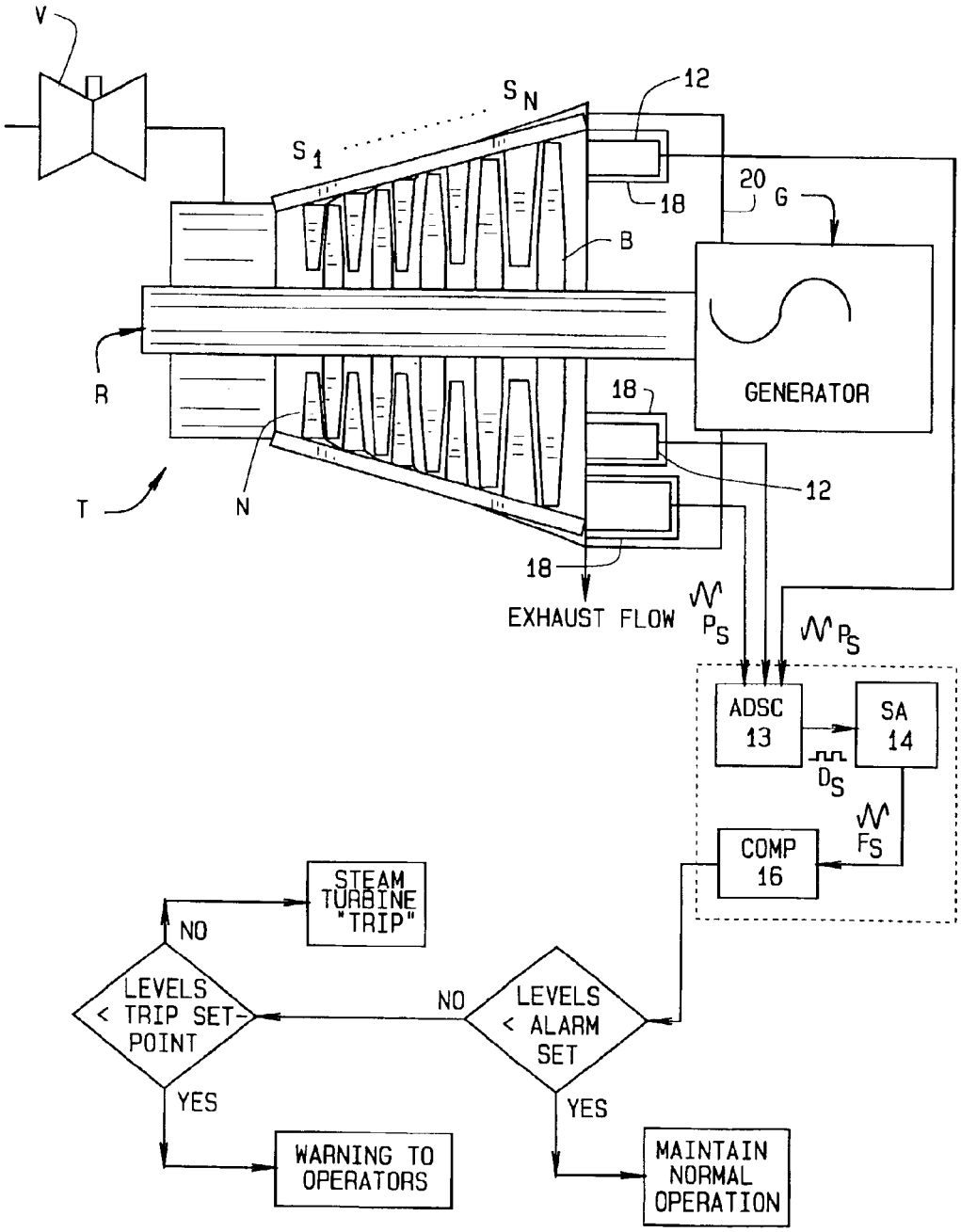
FIG. 4 is a representation of a control system of the present invention for controlling operation of the turbine.

In accordance with the invention, and as shown in FIG. 4, a steam turbine control system of the present invention is indicated generally 10. In accordance with the invention, one or more dynamic pressure sensors or probes 12 are positioned around the perimeter of the blades B comprising the last stage Sn of a turbine T. The transducer, such as those indicated 12*a* and 12*b* in FIG. 7, detect the pressure level or amplitude in this region of the turbine during its operation. Because the sensors are dynamic pressure sensors, they detect aeromechanical instabilities which cause distress to the turbine blades.

Figure 5:
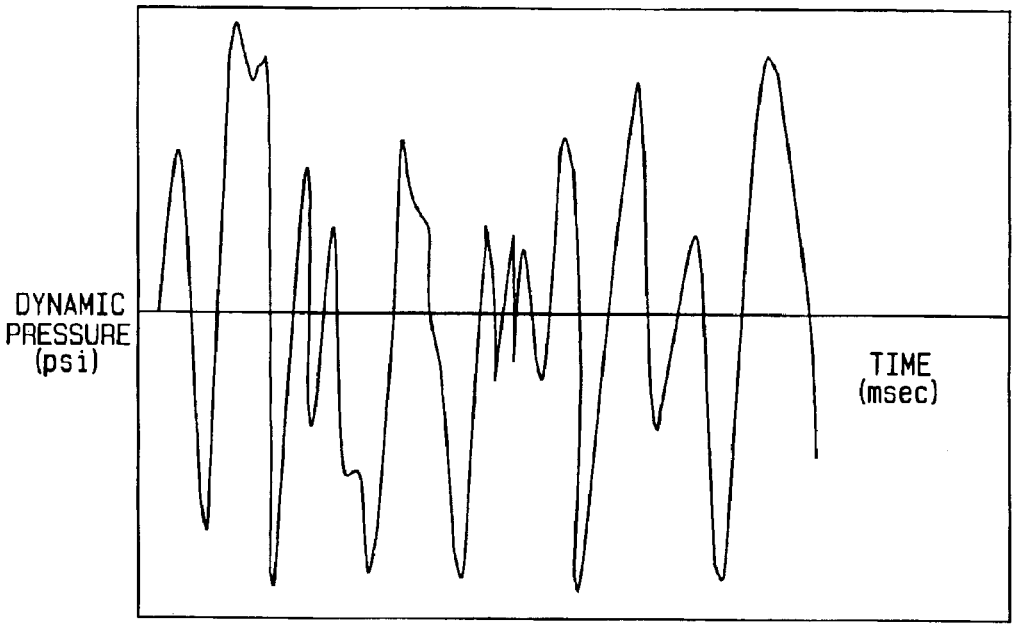
FIG. 5 is a graph illustrating a representative dynamic pressure signal measured as a function of time.
Figure 6:
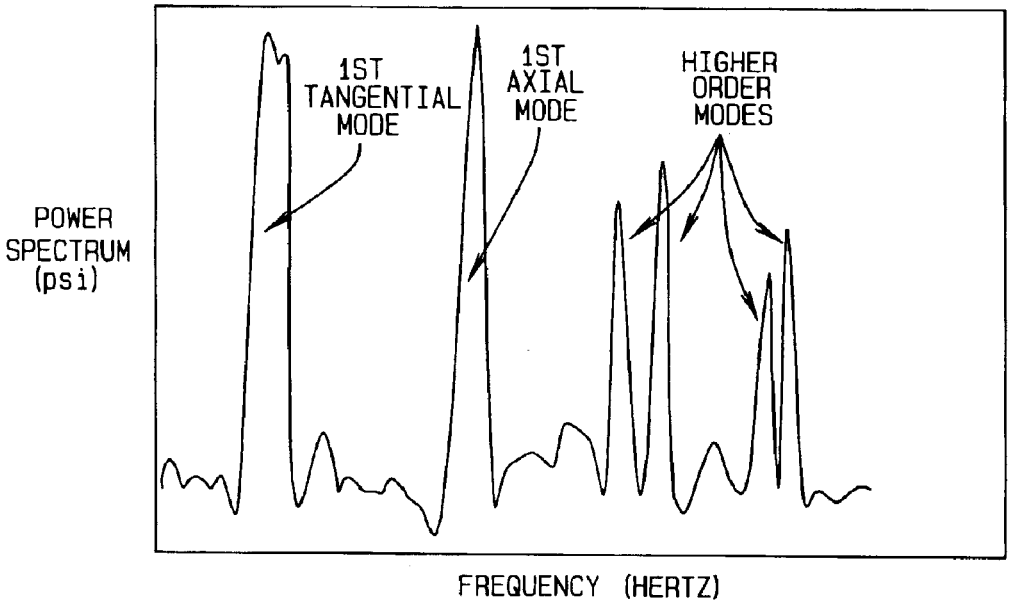
FIG. 6 is a graph illustrating a dynamic pressure spectrum.

The output of the pressure sensor are supplied as inputs to control system 10. In FIG. 5, the plot represents an exemplary output of the dynamic pressure measured by a sensor 12 over time. The time-dependent pressure signal Ps is transmitted as an analog signal of the type shown in FIG. 5. The sensor signals are supplied to an analog-to-digital converter (ADC) 13 where the input is converted to a digital signal Ds, which is provided as an input to a spectrum analyzer (SA) 14. Here the signal is converted, in turn, to a frequency based signal Fs. A commonly applied algorithm for this purpose is a fast Fourier transform (FFT). FIG. 6 shows a representative output of pressure versus frequency.

Turbine control system 10 now takes the frequency based signal Fs from analyzer 14 and supplies it as an input to a comparator (COMP) 16. Comparator 16 compares the pressure levels at various frequencies (as represented by signal Fs) to a matrix of limiting values stored within the comparator and including both alarm and trip signal limits. In one embodiment of the invention, system 10 utilizes a single dynamic pressure level sensor 12. In this embodiment, an alarm could be set to initiate if the pressure level in the last stage Sn of the turbine exceeds approximately 0.5 psi, for example. In the control system, the trip set point could be determined based upon providing protection to the turbine blades B, and could be set for 0.75 psi, for example.

As an extension to this approach, to provide greater operational frequency, alarm and trip points are set as a function of specific frequency ranges. Turbine designers commonly determine the resonant frequencies of blades B used in a turbine. Specific modes of common interest include a first tangential mode and a first axial rocking mode. Both of these are indicated in FIG. 6. A control schedule could then be defined as follows:

| Frequency Range (Hertz) | Alarm Level (psi) | Trip Level (psi) |
|---|---|---|
| 0–100 | 0.20 | 0.40 |
| 100–1000 | 0.15 | 0.30 |
| 1000–5000 | 0.10 | 0.20 |
| >5000 | 0.15 | 0.25 |

Those skilled in the art will understand that these levels are reference values only. A turbine designer will define actual set point limits based upon a number of factors including material properties, resonance characteristics, excitation sources, and damping effects.

Figure 1:
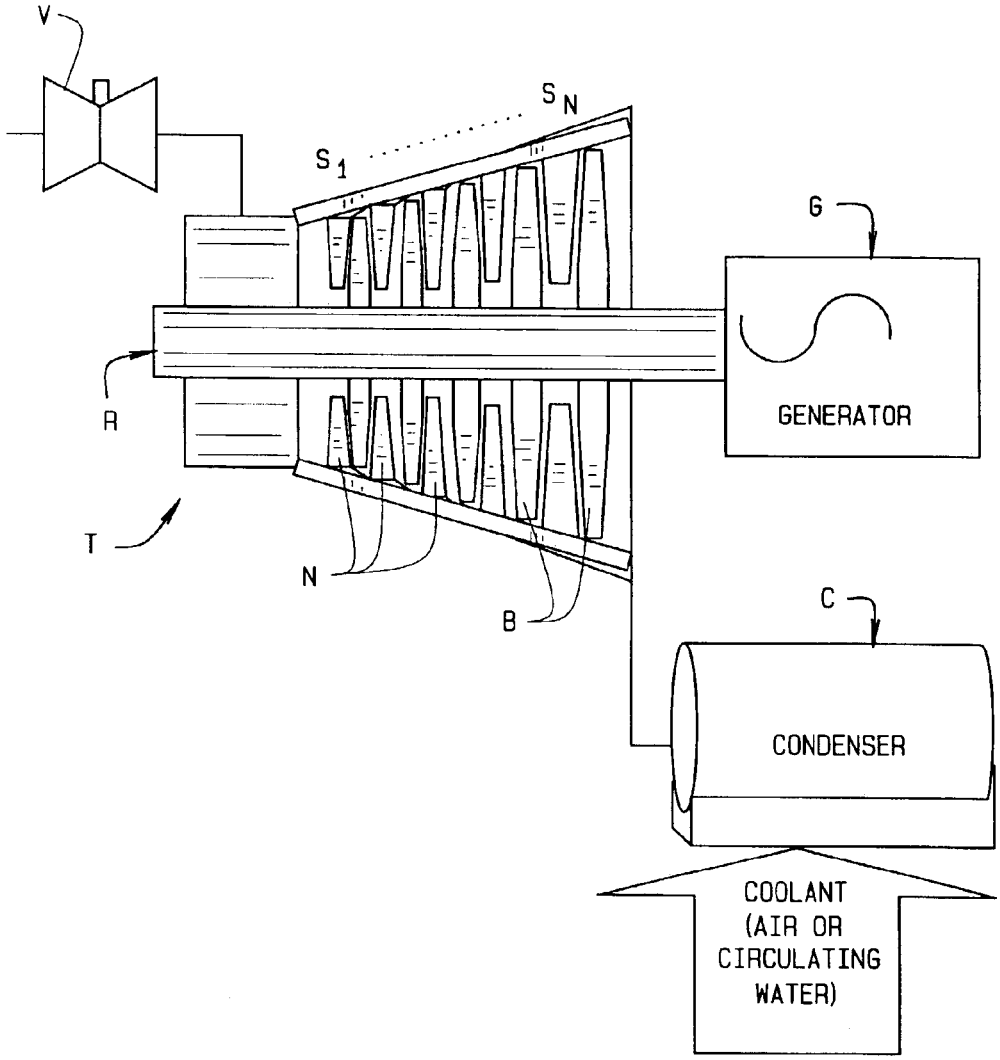
FIG. 1 PRIOR ART
FIG. 1 is a simplified representation of a steam turbine.
Figure 2:
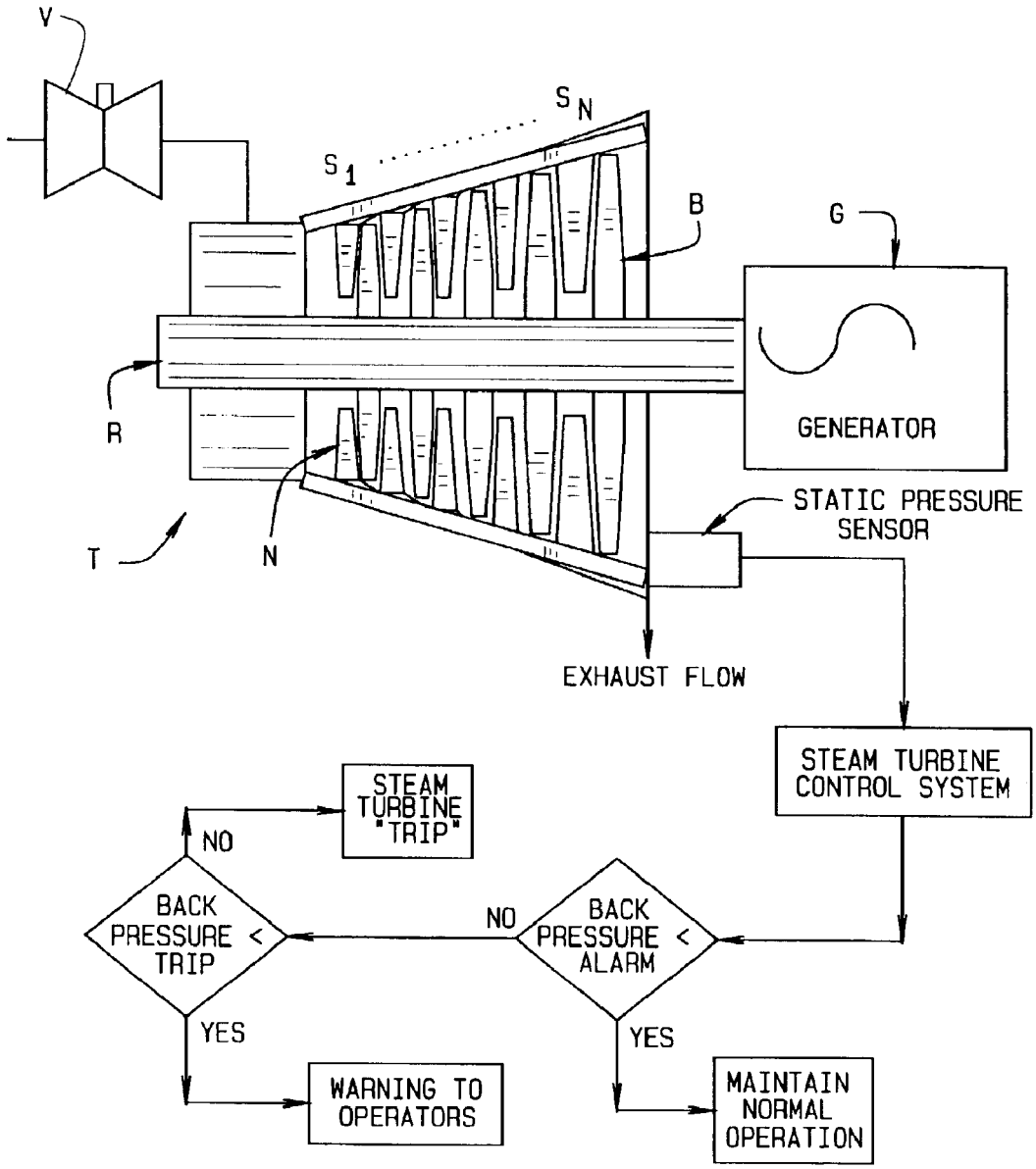
FIG. 2 PRIOR ART
FIG. 2 is a simplified representation of a control system for the turbine.
Figure 3:
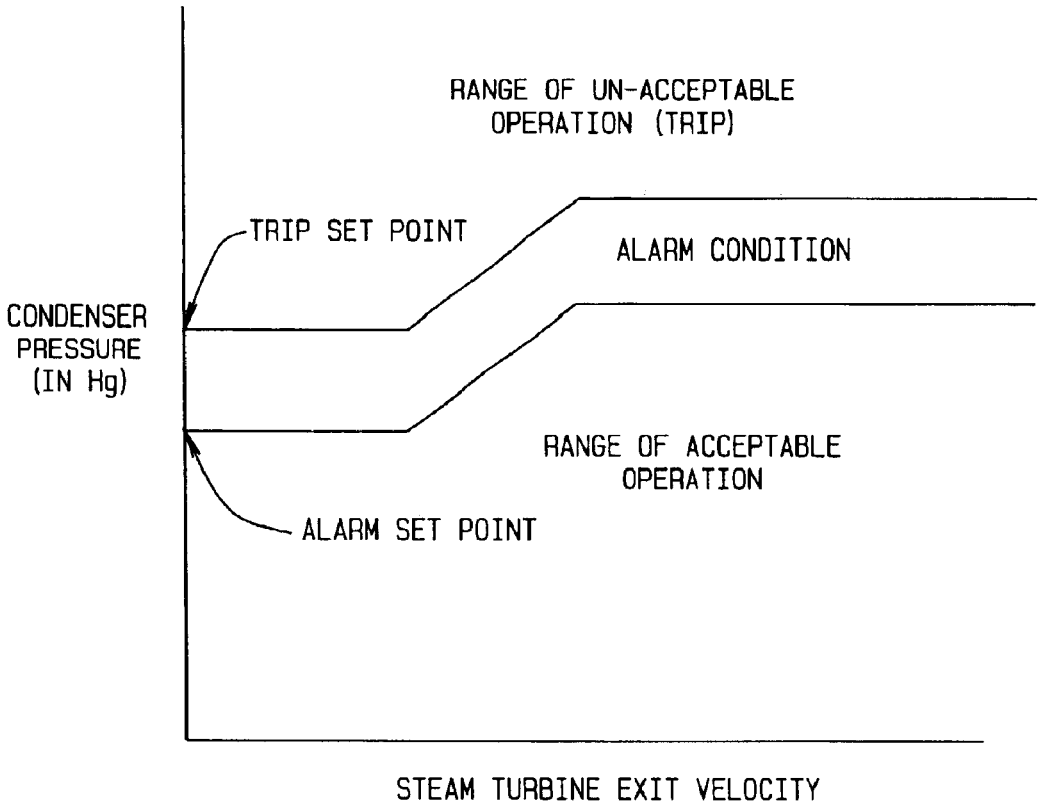
FIG. 3 PRIOR ART
FIG. 3 illustrates a conventional backpressure control schedule employed by the control system.
Figure 7:
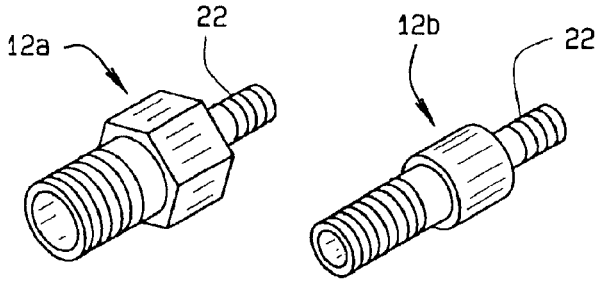
FIG. 7 is a perspective view of the type of dynamic pressure sensors used in the control system of the present invention.

In a second embodiment, multiple dynamic sensors 12 are placed around the circumference of turbine stage Sn to provide increased reliability. Now, a two-out-of-three type logic is used so to prevent a protective response due to failure of one of the sensors. The sensors are mounted in pressure ports 14 constructed around the circumference of a turbine hood 16 at axial positions consistent with the location of the blades of the last turbine stage Sn. As shown in FIG. 7, the sensors, which are commercially available, have threaded connections (as indicated at 22) for mounting the sensors in the turbine hood.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. A control system (10) for controlling operation of a steam turbine (T) to provide aeromechanical protection of blades (B) of the turbine without overly restricting operation of the turbine, comprising:

sensor means (12) sensing dynamic pressure level variations in a stage (S1–Sn) of the turbine;

means (13, 14) converting a signal (Ps) from the sensor means to a frequency based signal (Fs); and, means (16) for comparing the pressure levels at various frequencies as represented by the frequency based signal (Fs) to a matrix of limiting values including both alarm and trip signal limits, the control system providing an alarm to an operator of the steam turbine if the comparison indicates that an alarm limit has been exceeded, or taking the steam turbine off line, if the trip signal limit has been exceeded, so to prevent damage to the steam turbine, the control system however maintaining the steam turbine in operation if no aeromechanical disturbances or instabilities, as sensed by the sensor means has occurred.

2. The control system of claim 1 wherein the sensor means includes a plurality of dynamic pressure level sensors (12*a* or 12*b*) installed about the turbine stage.

3. The control system of claim 2 wherein the sensor means includes three dynamic pressure level sensors installed about the last stage (Sn) of the turbine.

4. The control system of claim 1 in which the signal (Ps) from the sensor means is an analog signal and the means converting a signal from the sensor means includes an analog-to-digital converter (13) converting the analog signal (Ps) to a digital signal (Ds).

5. The control system of claim 4 in which the means converting the signal from the sensor means further includes a spectrum analyzer (14) which converts the digital signal to a frequency based signal (Fs).

6. The control system of claim 5 in which the means for comparing includes a comparator (16) to which the frequency based signal is supplied as an input, the comparator comparing the pressure levels at various frequencies represented by frequency based signal to a matrix of limiting values including both the alarm and trip signal limits, the results from the comparison either maintaining current turbine operational status, providing an alarm indication to an operator of the turbine if an alarm limit is exceeded, or taking the turbine off line if a trip limit is exceeded.

7. The control system of claim 6 in which the sensor means includes three dynamic pressure level sensors installed about the last stage (Sn) of the turbine, each sensor providing a signal (Ps) which is to converted to a frequency based signal utilized by the comparator, the comparator employing a two-out-of-three logic so to prevent a protective response due to failure of one of the sensors.

8. The control system of claim 1 in which the alarm and trip signal limits are set as a function of specific frequency ranges.

9. A method of monitoring the operation of a steam turbine (T) as a function of backpressure conditions within the turbine to provide aeromechanical protection of blades (B) of the turbine without overly restricting operation of the turbine comprising:

sensing dynamic pressure level variations in a stage (S1–Sn) of the turbine and generating a signal (Ps) representative thereof;

converting the signal (Ps) representing a sensed dynamic pressure variation in a stage to a frequency based signal (Fs); and, comparing the pressure levels at various frequencies as represented by the frequency based signal (Fs) to a matrix of limiting values including both alarm and trip signal limits, and providing an alarm to an operator of the steam turbine if the comparison indicates that an alarm limit has been exceeded, or taking the steam turbine off line, if the trip signal limit has been exceeded, so to prevent damage to the steam turbine, the steam turbine being maintained in operation if no sensed aeromechanical disturbances or instabilities have occurred.

10. The method of claim 9 in which the alarm and trip signal limits are set as a function of specific frequency ranges.

11. The method of claim 9 wherein sensing dynamic pressure level variations includes a sensor means (16).

12. The method of claim 11 wherein the sensor means includes a plurality of dynamic pressure level sensors (12*a* or 12*b*) installed about the turbine stage.

13. The method of claim 12 wherein the sensor means includes three dynamic pressure level sensors installed about the last stage (Sn) of the turbine.

14. The method of claim 10 in which the signal (Ps) representing dynamic pressure level variations in a stage is an analog signal and a means (13, 14) are provided for converting this signal to the frequency based signal.

15. The method of claim 14 in which the means includes an analog-to-digital converter (13) converting the analog signal (Ps) to a digital signal (Ds).

16. The method of claim 15 in which the means further includes a spectrum analyzer (14) which converts the digital signal to a frequency based signal (Fs).

17. The method of claim 9 in which comparing the pressure levels at various frequencies includes supplying the frequency based signal is supplied as an input to a comparator (16), the comparator comparing the pressure levels at various frequencies represented by frequency based signal to a matrix of limiting values including both the alarm and trip signal limits, the results from the comparison either maintaining current turbine operational status, providing an alarm indication to an operator of the turbine if an alarm limit is exceeded, or taking the turbine off line if a trip limit is exceeded.

18. The method of claim 17 in which sensing dynamic pressure level variations includes three dynamic pressure level sensors installed about a last stage (Sn) of the turbine, each sensor providing a signal (Ps) which is to converted to a frequency based signal (Fs) supplied to the comparator, the comparator employing a two-out-of-three logic so to prevent a protective response due to failure of one of the sensors.

19. A control system (10) for controlling operation of a steam turbine (T) to provide aeromechanical protection of blades (B) of the turbine without overly restricting operation of the turbine, comprising:

three sensors installed about a last stage (Sn) of the turbine for sensing dynamic pressure level variations in the turbine;

means (13, 14) converting a signal (Ps) from each sensor means to a frequency based signal (Fs); and, a comparator (16) for comparing the pressure levels at various frequencies as represented by the frequency based signal (Fs) to a matrix of limiting values including both alarm and trip signal limits, the control system providing an alarm to an operator of the steam turbine if the comparison indicates that an alarm limit has been exceeded, or taking the steam turbine off line, if the trip signal limit has been exceeded, so to prevent damage to the steam turbine, the control system however maintaining the steam turbine in operation if no aeromechanical disturbances or instabilities, as sensed by the sensor means has occurred, the comparator employing a two-out-of-three logic so to prevent a protective response due to failure of one of the sensors.

20. The control system of claim 19 in which the signal (Ps) from each sensor is an analog signal and the means converting a signal from the sensor means includes an analog-to-digital converter (13) converting the analog signal (Ps) to a digital signal (Ds).

21. The control system of claim 20 in which the means converting the signal from the sensor means further includes a spectrum analyzer (14) which converts the digital signal to a frequency based signal (Fs).

22. The control system of claim 19 in which the frequency based signals are supplied as input to the comparator, the comparator comparing the pressure levels at various frequencies represented by frequency based signals to a matrix of limiting values including both the alarm and trip signal limits, the results from the comparison either maintaining current turbine operational status, providing an alarm indication to an operator of the turbine if an alarm limit is exceeded, or taking the turbine off line if a trip limit is exceeded.

23. The control system of claim 19 in which the alarm and trip signal limits are set as a function of specific frequency ranges.

* * * * *